United States Patent [19]

Ferland

[11] Patent Number: 4,824,068

[45] Date of Patent: Apr. 25, 1989

[54] FLEXIBLE FORM FOR STREET AND SIDEWALK CURBS

[76] Inventor: Guy Ferland, 749 Seigneuriale, Beauport, Québec, Canada, G1B 2B4

[21] Appl. No.: 206,747

[22] Filed: Jun. 15, 1988

[51] Int. Cl.[4] ..... E01C 19/50

[52] U.S. Cl. ..... 249/2; 249/4; 249/6; 249/18; 249/157; 249/159

[58] Field of Search ..... 249/2–8, 249/13, 17, 18, 157, 159, 170, 171, 192, 194; 52/631, 658; 404/7, 96, 97, 98

[56] References Cited

U.S. PATENT DOCUMENTS

| | | | |
|---|---|---|---|
| 965,979 | 8/1910 | Young | 249/2 |
| 1,140,776 | 5/1915 | Teters | 249/5 |
| 1,644,584 | 10/1927 | Heltzel | 249/8 |
| 1,770,518 | 7/1930 | Harrold | 249/5 |
| 1,939,007 | 2/1933 | Heltzel | 249/3 |
| 3,288,426 | 11/1966 | Simpson | 249/5 |
| 3,385,552 | 5/1968 | Von Drasek et al. | 249/4 |
| 4,340,200 | 7/1982 | Stegmeier | 249/3 |
| 4,679,763 | 7/1987 | Brotherton | 249/189 |

*Primary Examiner*—Jay H. Woo
*Assistant Examiner*—James C. Housel

[57] ABSTRACT

A flexible form for making street and sidewalk curbs uses C-channels such as is utilized in straight portions of street curbs, said C-channels carrying "V" openings spaced regularly evey 6 inches or so, to facilitate gradual bending, such opening being equipped with a U shaped spring which resists the bending and, at the same time, causes a uniform tension along the length of the curve. The V openings are located both in the straight interior part of the curve and in the slanted external part of the curve. The external part of the curve has other V slots vertically placed in the web and spaced one every 5 feet for a curve radius of 12 feet, such V slots correcting the vertical camber of an inclined bent form. The flexible form, once spring balanced, allows the casting of concrete in a continuous fashion.

4 Claims, 9 Drawing Sheets

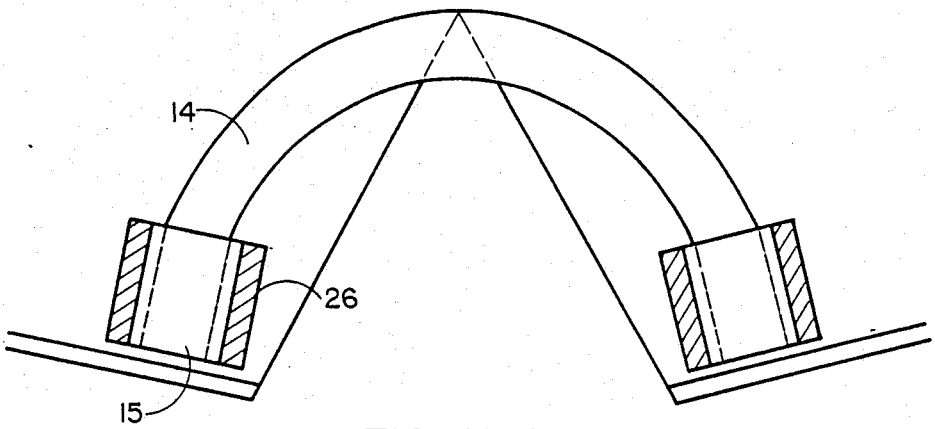
FIG. 11-C
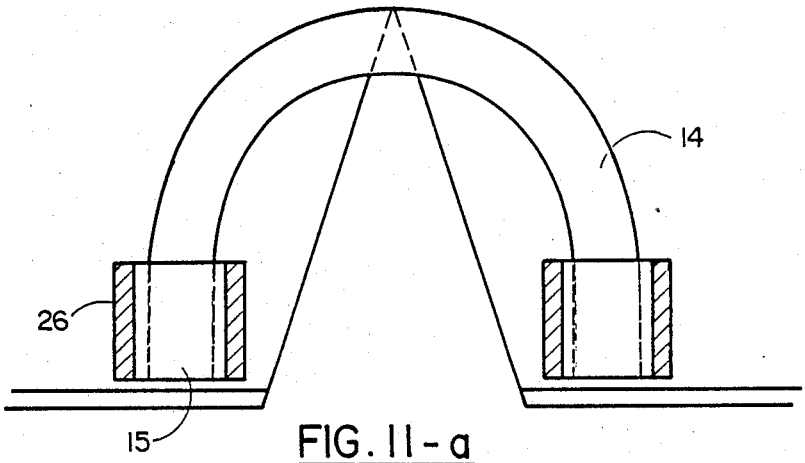
FIG. 11-a
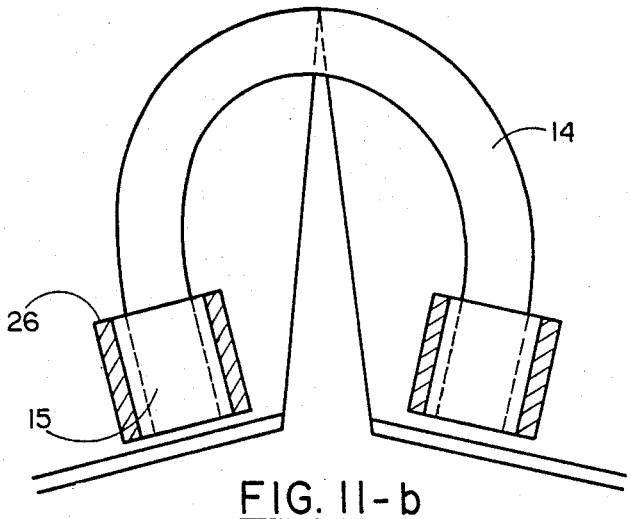
FIG. 11-b

FLEXIBLE FORM FOR STREET AND SIDEWALK CURBS

This invention relates generally to forms or molds for shaping and forming poured concrete structures such as radius of curbs and more particularly for continuous pouring along such radius.

BACKGROUND OF THE INVENTION

In the casting of concrete for street curbs, two forms are normally used of which one is placed at right angle with the ground and the other at a slant or acute angle. The concrete is poured in these forms up to the end of the street but must be interrupted before the curve and begin again on the other side of the curve. It is only when the concrete has hardened, that the curve form, made of plywood, may be installed to complete the pouring of the concrete. The methods of making concrete curbs are known from the following patents:

1. Teters in U.S. Pat. No. 1,140,776 in 1915 shows parallel sections held in place by pegs.
2. C-channels are used by Heltzel U.S. Pat. No. 1,644,584 in 1927, of which one is perpendicular to the ground and the other at an angle, but for a straight section only.
3. Harrold U.S. Pat. No. 1,770,518 utilizes parallel flat steel for a 90° curve.
4. In 1933, Heltzel exposes a vertical adjustment creating a Vee opening at the ends of forms, to account for up and down adjustments in terrain U.S. Pat. No. 1,939,007.
5. Von Drasek reports in 1968, U.S. Pat. No. 3,385,552, a concave/convex arrangement to facilitate the curving of flat steel forms.
6. A spring is used in conjunction with the supporting pegs, Stegmeier U.S. Pat. No. 4,340,200 in 1982.

But none of the above describes completely the characteristics of my invention.

SUMMARY OF THE INVENTION

The primary object of my invention is to provide a novel construction of steel forms for sheets or high-way work, and particularly a form which permits the continuous formation of a curb along a street corner by casting concrete continuously.

A further object of my invention is to provide a form which is flexible, to follow any contour and different radius.

Another object is to provide a balanced structure so that a uniform tension is exerted on the web of the form without kink or breakage in certain locations. Another object is to offer a cement tight structure when a slanted mold is bent around a curve.

Finally another object is to provide a method to be utilized for gutters and sidewalks.

Other objects and advantages will be apparent as the description proceeds, reference being had to the accompanying drawings wherein like reference numeral indicate like part.

The improved form means of the present invention comprises several features which when used in combination permit the continuous casting of the concrete curb along the radius and according to different shapes. I have conceived a mold for continuous casting of concrete in a mold bent around a required curve and with a continuous slope on the external side. I use a steel form having a web and two wings with horizontal Vee openings in the wings, with springs maintaining the rigidity of the structure without deformation. To diminish the camber on the inclined side, I have conceived a form with a Vee opening cut in the web and with a spring uniting the two sides as a stabilizer.

BRIEF DESCRIPTION OF THE DRAWINGS

In the drawings:

FIGS. 2*a* is a top view along cut B—B of FIG. 2.

FIG. 3 also illustrates both the straight interior form 1 and the inclined exterior form 2 showing the method of joining the ends, and the extension piece to equalize the ends. The spring 14 which is shown in the external form 2 is opened up and under tension.

FIG. 6 shows the spring in the relaxed position, before a downward force is applied to the sides of the Vee opening 13.

FIG. 11 shows the three positions of spring 14 held by welded sockets 15.

FIG. 11*a* referring to FIG. 4 represents the spring 14 at rest.

FIG. 11*b* referring to FIG. 5*b* represents spring 14 closed and under compression.

FIG. 11*c* referring to FIG. 8 represents spring 14 opened up and under tension.

DESCRIPTION OF A PREFERRED EMBODIMENT

Figure 1:
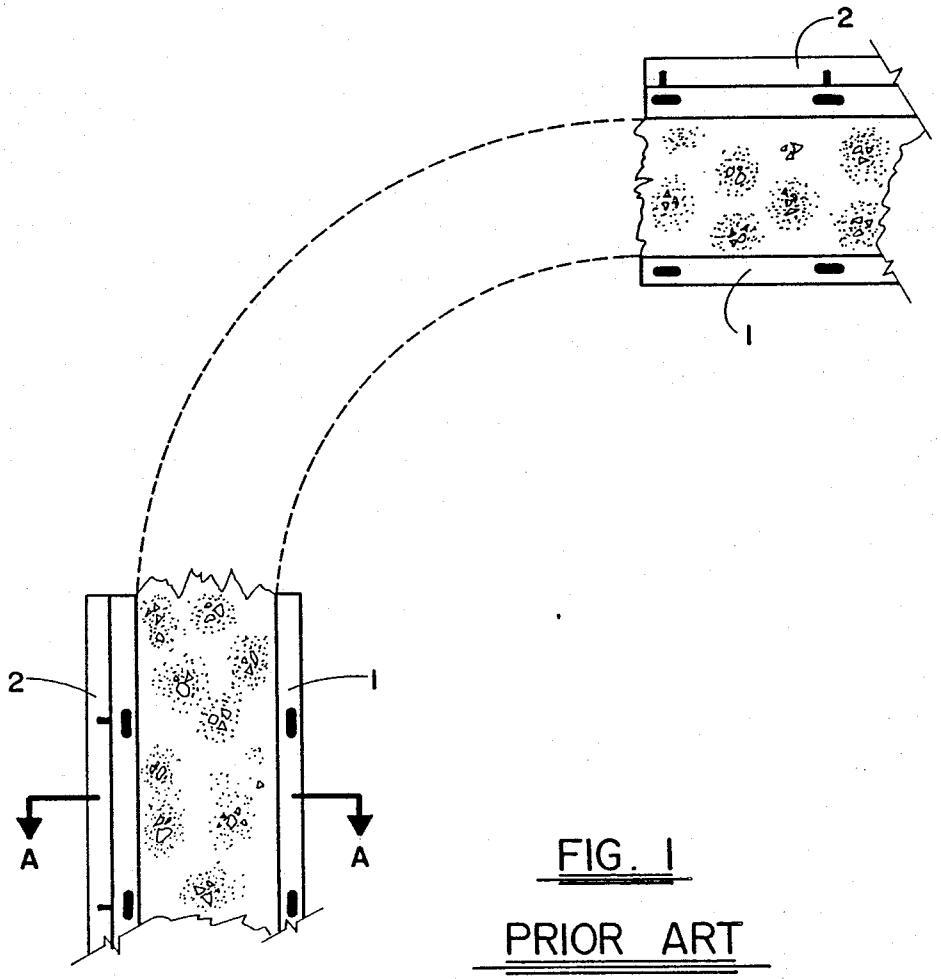
FIG. 1 PRIOR ART
FIG. 1 is a top plan view of a street curb according to the present state of the art, showing two straight mold parts located at right angle. Concrete is poured in the two right angle mold sections and must be let to harden before a form may be secured to the two solid sections for pouring the concrete around the curve. The figures shows a top view of two forms: one interior form placed at right angle to the ground and one external form which is placed at a slant angle. Each form is normally made in ten foot sections.
Figure 2:
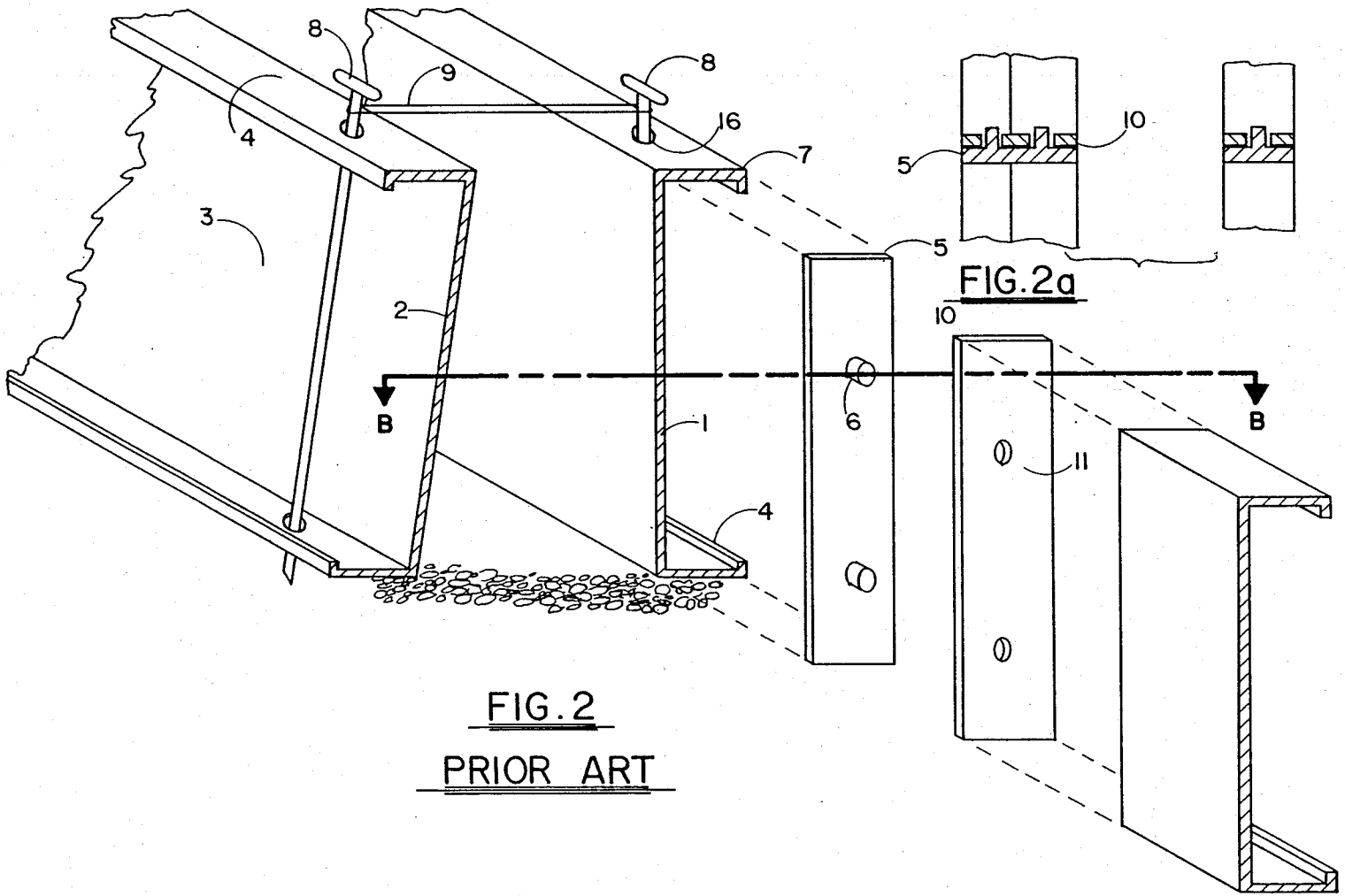
FIG. 2 PRIOR ART
FIG. 2 is an end view of a cut A—A of FIG. 1 at the end of a ten foot section, where a section of form is attached to the next section of form. The figure shows the C-shape form, in addition to the means for securing the form to the ground, and the male-female arrangement for attaching two neighboring sections together.
Figure 3:
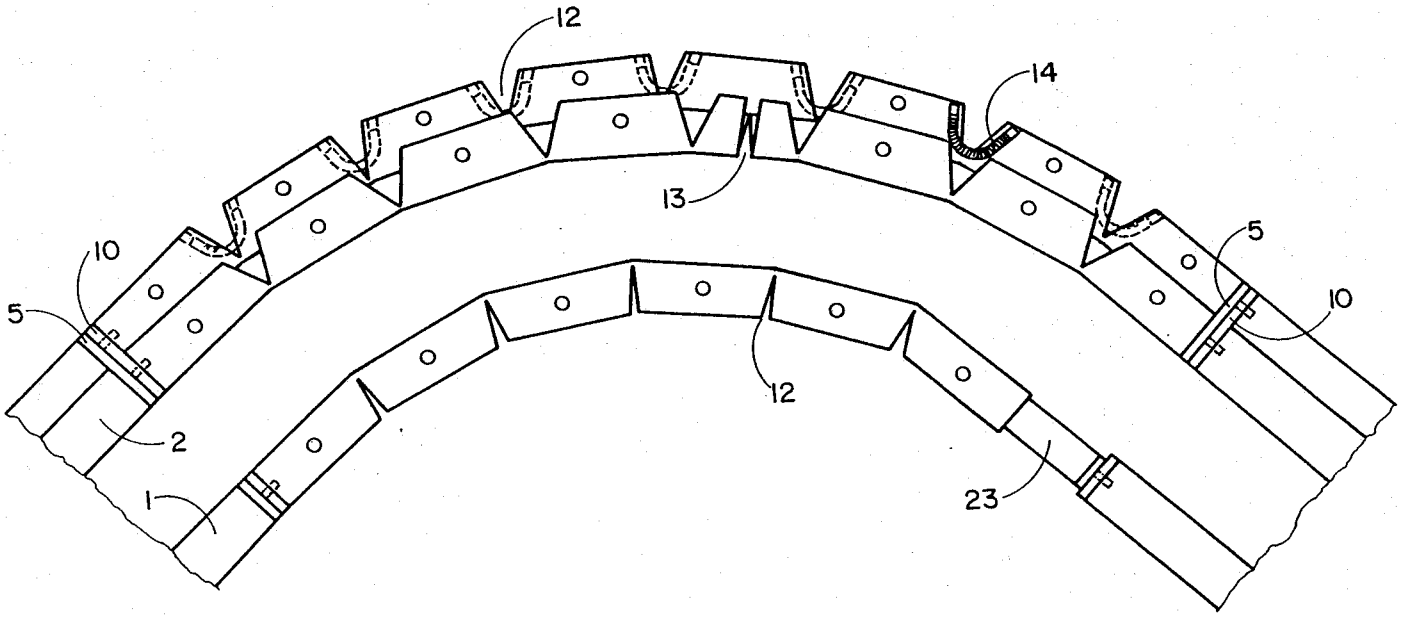
FIG. 3 is a top plan view of the flexible form of my invention in position during the pouring of the concrete illustrating that the Vee openings are uniformly spaced along the length of the curve and more closed on the interior side and more opened on the exterior side of the forms.
Figure 4:
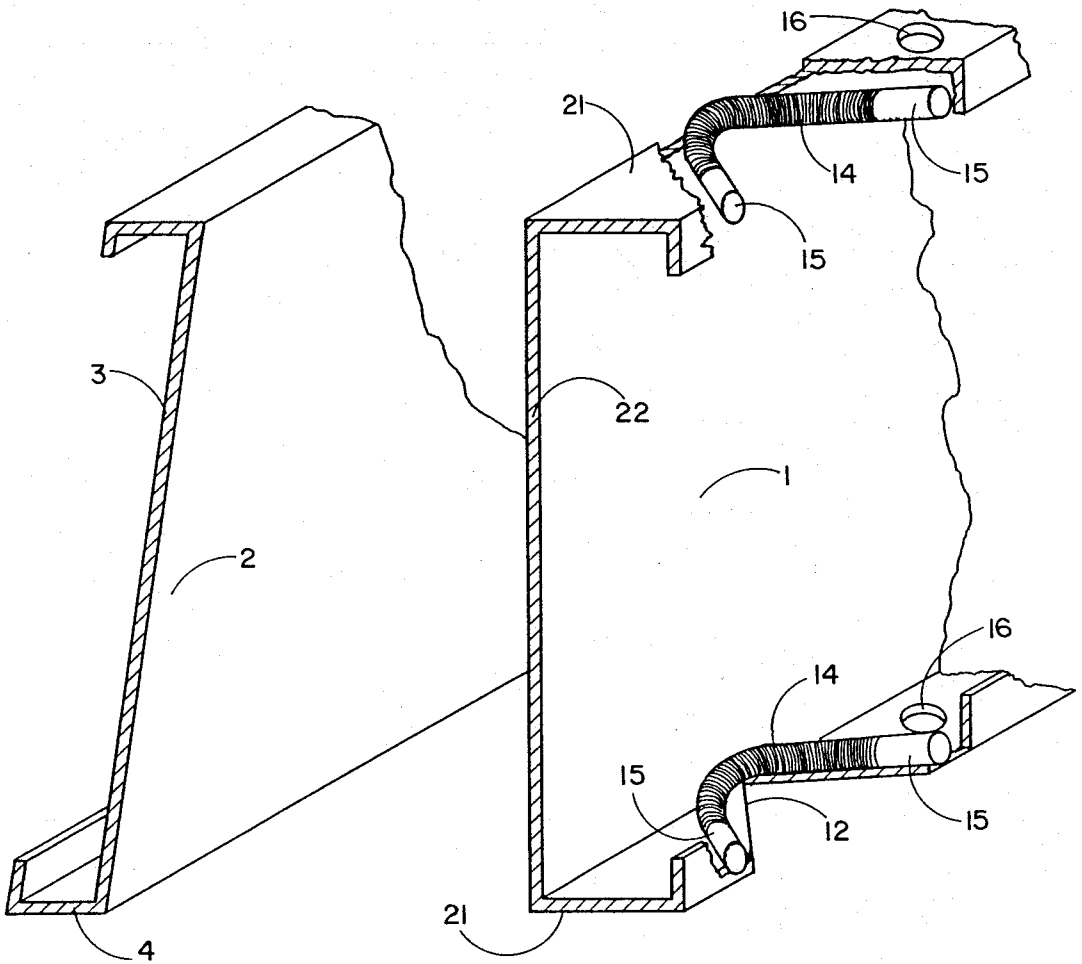
FIG. 4 represents a face detailed view of the form at right angle with the ground, illustrating the Vee shaped opening as well as a U shaped spring which straddles the opening and the sleeves which hold the ends of the aforementioned spring. The spring 14 is shown at rest.
Figure 5A:
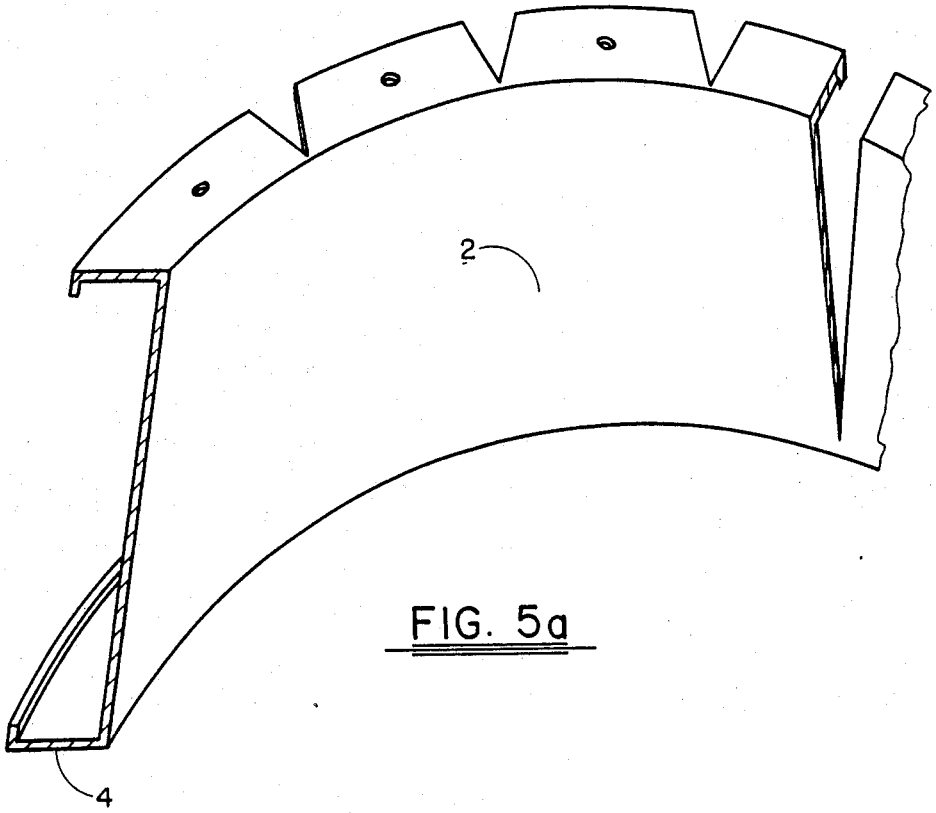
FIG. 5*a* is an enlarged view of FIG. 5 showing the opening up of the Vee shaped openings in the wings of the form when the form is bent around a curve.
Figure 5:
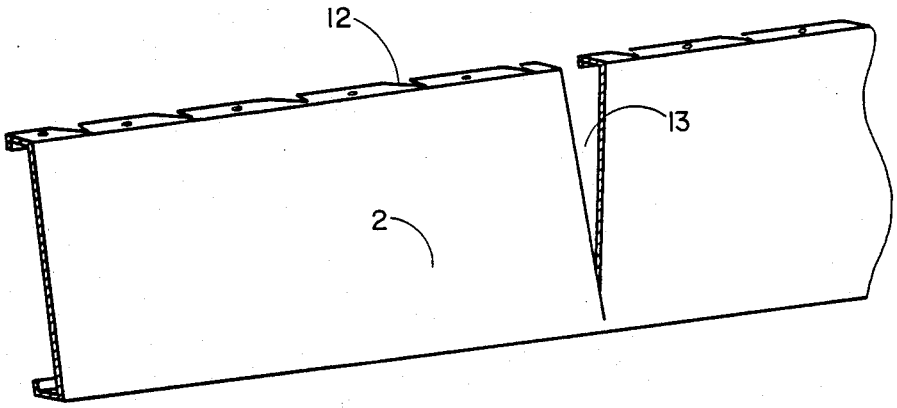
FIG. 5 is a front view of the form which is positioned at an angle with the ground, showing a vertical Vee shaped opening in the web of the form in order to diminish the camber which causes a void underneath when an inclined form is bent around a radius.
Figure 5B:
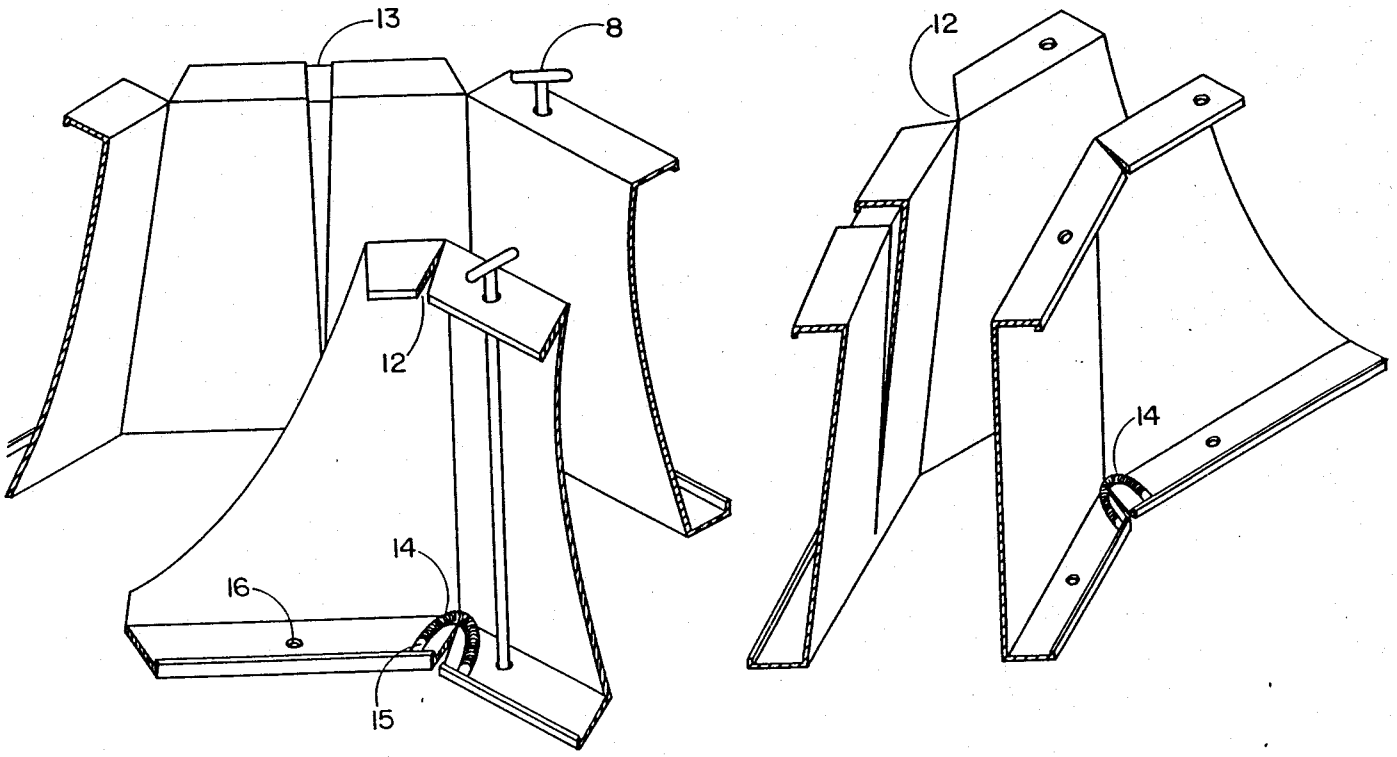
FIG. 5*b* is an exaggerated view of segments of the form illutrating the function of each opening and of each spring, as well as showing the functioning of the Vee opening in the web. The spring 14 shown is closed and under compression as is to happen at each Vee opening 12 in the interior form 1.
Figure 6:
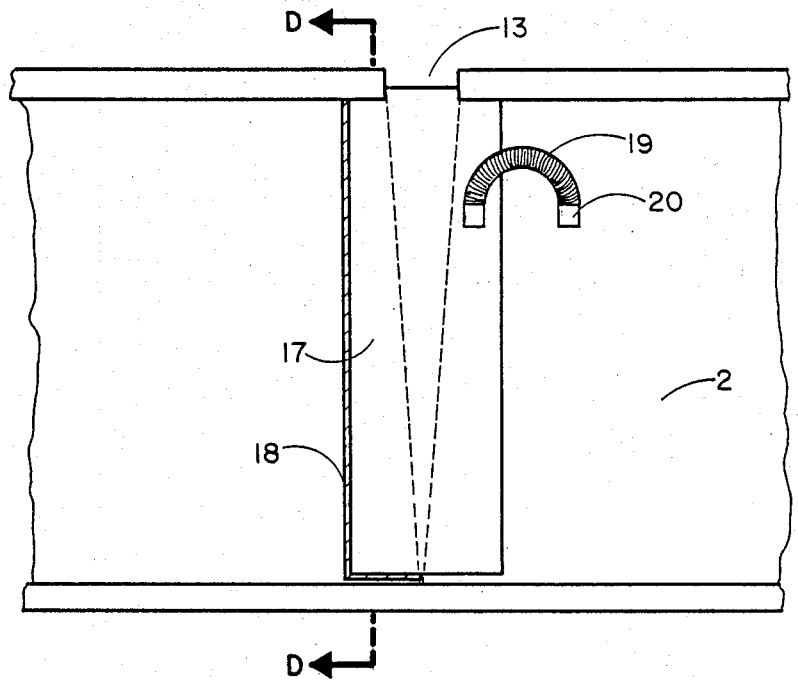
FIG. 6 represents the sliding plate as well as the spring which controls such sliding plate and the sleeves which hold the spring.

The illustrated form is similar to FIG. 3 and is made of two pieces of steel, the number 1 being perpendicular to the ground and the number 2 being at a slant angle with the ground. The slant angle part 2 has a slanted web 3 and horizontal wings 4. The vertical part 1 has the same configuration.

The two pieces 1 and 2 are parallel but each one has a male and a female end to assure continuity. At the end of each curb mold is a plate 5 welded to the end 7 of the sections, with dowel pins 6 on the male part and holes 11 on the female part 10. The form 1 is on the internal side of the curve and the form 2 is on the external side.

The form 1 has Vee openings 12 made in the wings at such distance that the piece can form an arc of a circle when forced in this position.

The Vee openings 12 have springs 14 held by sockets 15. Each spring 14 is in neutral state when the web 2 in the region of the Vee opening is straight and exerting a bias when the web is curved either way from its straight condition. The tension of the spring as well as its rigidity procure flexibility and stability to the whole mold.

The slanted form 2 also has Vee openings 12 such as in form 1, with springs 14 and sleeves 15.

A vertical Vee opening 13 is made in the web 3 of the steel structure 2 to allow the reduction of 4 cm in the top perimeter and permit a continuous slant in the curve while the whole mold 2 rests on the ground. There may be two or more vertical Vee openings 13, but they must totalize 4 cm in opening length.

A plate 17 is welded to the web 3 of the form 2 on one side of the vertical Vee opening 13, and is sliding on the second side, making the alignment of the mold. This plate 17 also allows to keep the joint tight. On the top of the Vee opening 13, two hollow sockets 11 are welded, one on the sliding plate 10 and the other on the web 3 of the form 2.

A U spring 19, sitting astride the Vee opening 13, is fixed in the sockets 20 before they are being welded to hold back the spring 19. Such spring 19 is neutral when the form is straight and stressed when the form is in a curved position.

Holes 16, at the top and the bottom of the wings of the two forms 1 and 2, allow the insertion of the cramps 8. In the slanted form 2, the length of the curve is longer at the bottom than at the top, its perimeter being of a quarter of a circle, $\frac{1}{4}\pi$X d.

| Interior top radius | Exterior bottom radius | Perimeter | Difference top/bottom |
|---|---|---|---|
| 2 m | 2.05 | $\frac{1}{4}\pi \times$ d | .05 $\pi/4$ |
| 3 m | 3.05 | $\frac{1}{4}\pi \times$ d | .05 $\pi/4$ |
| 4 m | 4.05 | $\frac{1}{4}\pi \times$ d | .05 $\pi/4$ |

The slant is of 0.05 m on a height of 0.35 m, and the difference in the perimeter between a slant curve and a vertical curve is always 0.05 $\pi/4$ or 0.04 m or 4 cm at the bottom, compared to the top.

The form with a straight angle 1 has an extensible part 23 which allows the correction of the difference in length between the vertical form, at the internal side of the curve, and the slanted form, at the external side of the curve.

Figure 8:
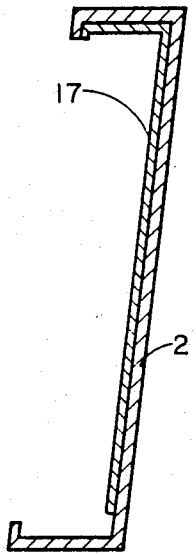
FIG. 8 is a cut along line D—D of FIG. 6 representing a cut view of the sliding plate 17.
Figure 7:
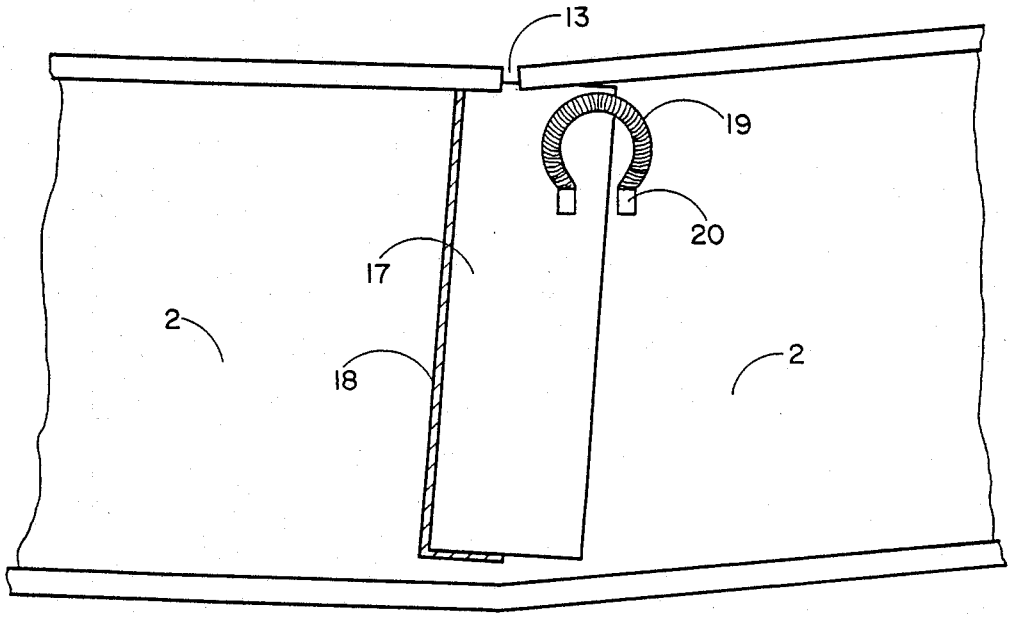
FIG. 7 shows when the opening is closed, thereby moving the sliding plate 17 and compression spring 19 held by socket pins 20.
Figure 9:
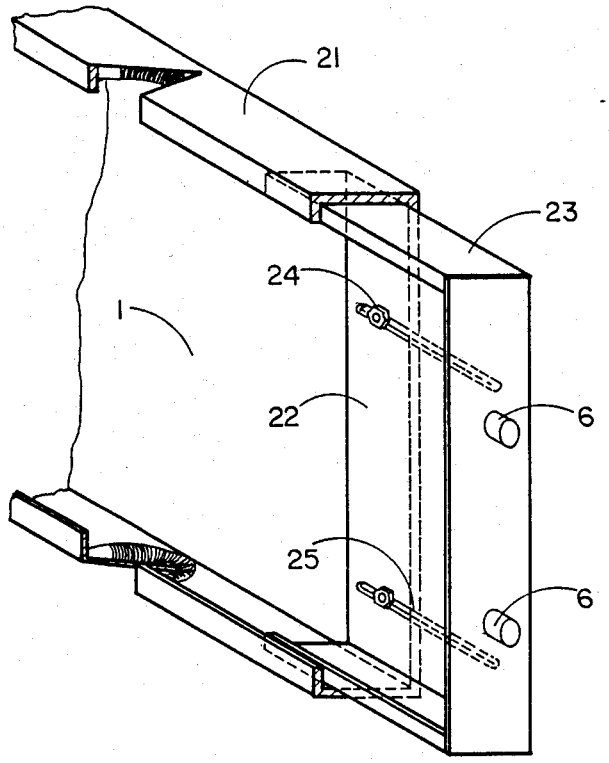
FIG. 9 is a face view of extension 9 of form 1 at right angle with the ground; such form is normally built shorter than the external form, the extension serving to adjust to the same arc length as the external form.
Figure 10:
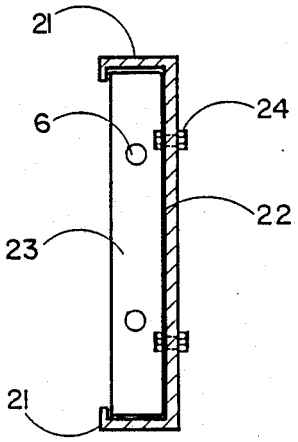
FIG. 10 represents a cut away view of the extension illustrated at FIG. 9.

The distance between the forms 1 and 2 is usually evenly of 0.15 m, wich implies that the difference in the length of the arcs 14 and 15 is also even, as shown in FIG. 8.

Radius R in meter, perimeter P for $\frac{1}{4}$ of a turn.

| Radius R | P* | External P | Difference | Number of forms of 3 m |
|---|---|---|---|---|
| 2 m | $\pi$ | $\pi/2$ (R+.15) | .25 m | 1 |
| 6 m | 3 $\pi$ | $\pi/2$ (R+.15) | .25 m | 3 |
| 10 m | 5 $\pi$ | $\pi/2$ (R+.15) | .25 m | 5 |

*On the inside.

On the outside, add to radius R the distance 0.15 m which is the space between the two forms. The difference in the length of the arc is given by the formula $\pi/2 \times 0.15 = 0.25$ m. When there are many forms forming the perimeter, the adjustment of the extension is distributed evenly between the forms.

I claim:

1. A flexible form for pouring concrete to form a curved wall, said form including spaced inner and outer "C" channels each having a web interconnecting a pair of vertically spaced wings in which each wing has a plurality of first Vee openings spaced longitudinally along the channel and a spring straddling each opening, the ends of said spring being fixed to each side of the Vee opening, each spring being in a neutral unbiased state when the web adjacent to the Vee opening is straight, and exerting a bias when the web is curved either way from said straight condition.

2. A form as defined in claim 1, in which the inner channel web is set at a right angle to the ground and the outer channel web is slanted relative to the ground to procure a slant to the concrete, the slanted channel having a second Vee shaped opening extending transversely of the channel from the upper wing downwards through the web, such opening being covered by a sliding plate fixed to the web on one side of the second Vee opening and free to slide on the other side of the second Vee opening.

3. A flexible form as defined in claim 2, further including a second spring having one end fixed to the sliding plate and the other end fixed to the web on the other side of the second Vee opening.

4.

A form as defined in claim 1, in which the inner channel has a sliding extension allowing an adjustment in differences of length between internal and external perimeters of the wall.

* * * * *